US008628084B1

(12) United States Patent
Shin et al.

(10) Patent No.: US 8,628,084 B1
(45) Date of Patent: Jan. 14, 2014

(54) GAMING MACHINE HAVING HUB-LESS REELS

(71) Applicant: WMS Gaming Inc., Waukegan, IL (US)

(72) Inventors: Nickey C. Shin, Chicago, IL (US); Timothy C. Loose, Chicago, IL (US); Scott A. Massing, Lincolnwood, IL (US); Walter E. Smolucha, Melrose Park, IL (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

(21) Appl. No.: 13/783,260

(22) Filed: Mar. 2, 2013

(51) Int. Cl.
*G07F 17/34* (2006.01)

(52) U.S. Cl.
USPC ..... 273/143 R; 273/138.2; 463/20; 463/34

(58) Field of Classification Search
USPC ..... 273/143 R, 138.2; 463/20, 34
See application file for complete search history.

(56) References Cited

U.S. PATENT DOCUMENTS

| | | | | |
|---|---|---|---|---|
| 4,200,291 | A | 4/1980 | Hooker | 273/143 R |
| 4,273,333 | A | 6/1981 | Nicolaus | 273/143 R |
| 4,358,114 | A | 11/1982 | Burnside | 273/143 R |
| 4,411,428 | A | 10/1983 | Nicolaus | 273/143 R |
| 4,427,196 | A | 1/1984 | Hooker et al. | 273/143 R |
| 4,486,116 | A | 12/1984 | Sassi | 403/367 |
| 4,492,379 | A | 1/1985 | Okada | 273/143 R |
| 4,621,815 | A | 11/1986 | Yamamoto | 273/143 R |
| 4,637,611 | A | 1/1987 | Hamada | 273/143 R |
| 4,660,833 | A | 4/1987 | Dickinson et al. | 273/143 R |
| 4,741,532 | A | 5/1988 | Okada | 273/143 R |
| 4,765,078 | A | 8/1988 | Yamamoto | 40/309 |
| 4,772,022 | A | 9/1988 | Yoshitomi | 273/143 R |
| 4,773,647 | A | 9/1988 | Okada et al. | 273/143 R |
| 5,046,738 | A * | 9/1991 | Coates | 273/143 R |
| 5,058,893 | A | 10/1991 | Dickinson et al. | 273/143 R |
| 5,102,136 | A | 4/1992 | Heidel et al. | 273/143 R |
| 5,248,019 | A | 9/1993 | Sbarro | 180/219 |
| 5,388,829 | A | 2/1995 | Holmes | 273/143 R |
| 5,419,619 | A | 5/1995 | Lew | 301/5.1 |
| 5,423,540 | A | 6/1995 | Taxon | 273/143 R |
| 5,683,296 | A | 11/1997 | Rasmussen | 463/20 |
| 5,839,957 | A | 11/1998 | Schneider et al. | 463/20 |
| 5,879,234 | A | 3/1999 | Mengual | 463/20 |
| 5,938,196 | A | 8/1999 | Antoja | 273/143 C |
| 6,027,115 | A | 2/2000 | Griswold et al. | 273/143 R |
| 6,086,066 | A | 7/2000 | Takeuchi et al. | 273/143 R |
| 6,129,355 | A | 10/2000 | Hahn et al. | 273/142 R |
| 6,402,624 | B1 | 6/2002 | Larson et al. | 472/44 |
| 6,705,630 | B1 | 3/2004 | Karpman | 280/253 |
| 7,038,411 | B2 | 5/2006 | Nireki et al. | 318/370 |
| 7,137,885 | B1 | 11/2006 | Loose | 463/20 |
| 7,150,070 | B2 | 12/2006 | Donakowski | 16/45 |
| 7,207,883 | B2 * | 4/2007 | Nozaki et al. | 463/24 |
| 7,426,970 | B2 | 9/2008 | Olsen | 180/65.1 |

(Continued)

FOREIGN PATENT DOCUMENTS

| | | | |
|---|---|---|---|
| WO | WO 94/26227 | 11/1994 | A61G 5/10 |
| WO | WO 2012/171821 A1 | 12/2012 | B62K 3/00 |

*Primary Examiner* — Benjamin Layno
(74) *Attorney, Agent, or Firm* — Nixon Peabody LLP

(57) ABSTRACT

A gaming machine includes at least one cylindrical mechanical reel mounted in a cabinet. The mechanical reel includes symbols displayed to indicate, at least in part, a randomly selected outcome of a wagering game. The mechanical reel is rotatable about an internal axis and defines an interior space that is free of a hub along the internal axis.

30 Claims, 13 Drawing Sheets

(56) References Cited

U.S. PATENT DOCUMENTS

| | | | | |
|---|---|---|---|---|
| 7,473,173 | B2 | 1/2009 | Peterson et al. | 463/20 |
| 7,657,969 | B2 | 2/2010 | Trivini | 16/45 |
| 7,938,210 | B2 | 5/2011 | Künzler et al. | 180/65.51 |
| 8,002,624 | B2 | 8/2011 | Paulsen et al. | 463/20 |
| 8,113,524 | B2 | 2/2012 | Karpman | 280/63 |
| 8,246,441 | B2 | 8/2012 | Bleich et al. | 463/20 |
| 8,277,304 | B1 | 10/2012 | Rasmussen et al. | 463/20 |
| 8,298,069 | B2 | 10/2012 | Gowin | 463/20 |
| 8,414,006 | B2 | 4/2013 | Souvanny | 280/260 |
| 8,464,822 | B2 | 6/2013 | Spector et al. | 180/219 |
| 2007/0209855 | A1 | 9/2007 | Burkiewicz | 180/223 |
| 2010/0306962 | A1 | 12/2010 | Breyer et al. | 16/46 |
| 2011/0209938 | A1 | 9/2011 | Basadzishvili | 180/305 |
| 2011/0220427 | A1 | 9/2011 | Chen | 180/21 |

* cited by examiner

GAMING MACHINE HAVING HUB-LESS REELS

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to a mechanical reel having a hub-free interior space.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

Traditionally, gaming machines operate under control of a processor that has been programmed to execute base games and bonus games in which reel arrays spin and stop to display symbol combinations in a display area. If winning combinations are achieved by the symbol combinations, awards are provided to the players.

The reel arrays include mechanical reels configured in the form of a wheel having a hub, which consists of motors and spokes inside the wheel and occupying an internal axis thereof. Lighting circuitry in these reels is limited to available space outside the motor mechanism and, often, outside the reels. To maintain visual aesthetics, all mechanical and electronic circuits are hidden behind a face plate such as a marquee or a plain bezel. The reel strips themselves are substantially opaque or translucent to hide the mechanical components, and, consequently, limit options for lighting effects.

SUMMARY OF THE INVENTION

According to one aspect of the present invention, a gaming machine includes at least one cylindrical mechanical reel mounted in a cabinet. The mechanical reel includes symbols displayed to indicate, at least in part, a randomly selected outcome of a wagering game. The mechanical reel is rotatable about an internal axis and defines an interior space that is free of a hub along the internal axis.

According to another aspect of the invention, a gaming machine includes at least one cylindrical mechanical reel that is mounted to display symbols indicative, at least in part, of a randomly selected outcome of a wagering game. The mechanical reel is rotatable about an internal axis and includes an outer rim. The gaming machine further includes a motor and drive train configured to rotate the mechanical reel about the internal axis. The motor and drive train are mounted adjacent to the outer rim and away from the internal axis.

According to yet another aspect of the invention, a gaming machine includes at least one cylindrical mechanical reel mounted to display symbols indicative, at least in part, of a randomly selected outcome of a wagering game. The mechanical reel is rotatable about an internal axis and includes an outer rim. The mechanical reel further contains a central space around the internal axis. The gaming machine further includes a motor and drive train configured to rotate the mechanical reel about the internal axis. The motor and drive train are mounted adjacent to the outer rim and outside the central space.

Additional aspects of the invention will be apparent to those of ordinary skill in the art in view of the detailed description of various embodiments, which is made with reference to the drawings, a brief description of which is provided below.

Figure 1:
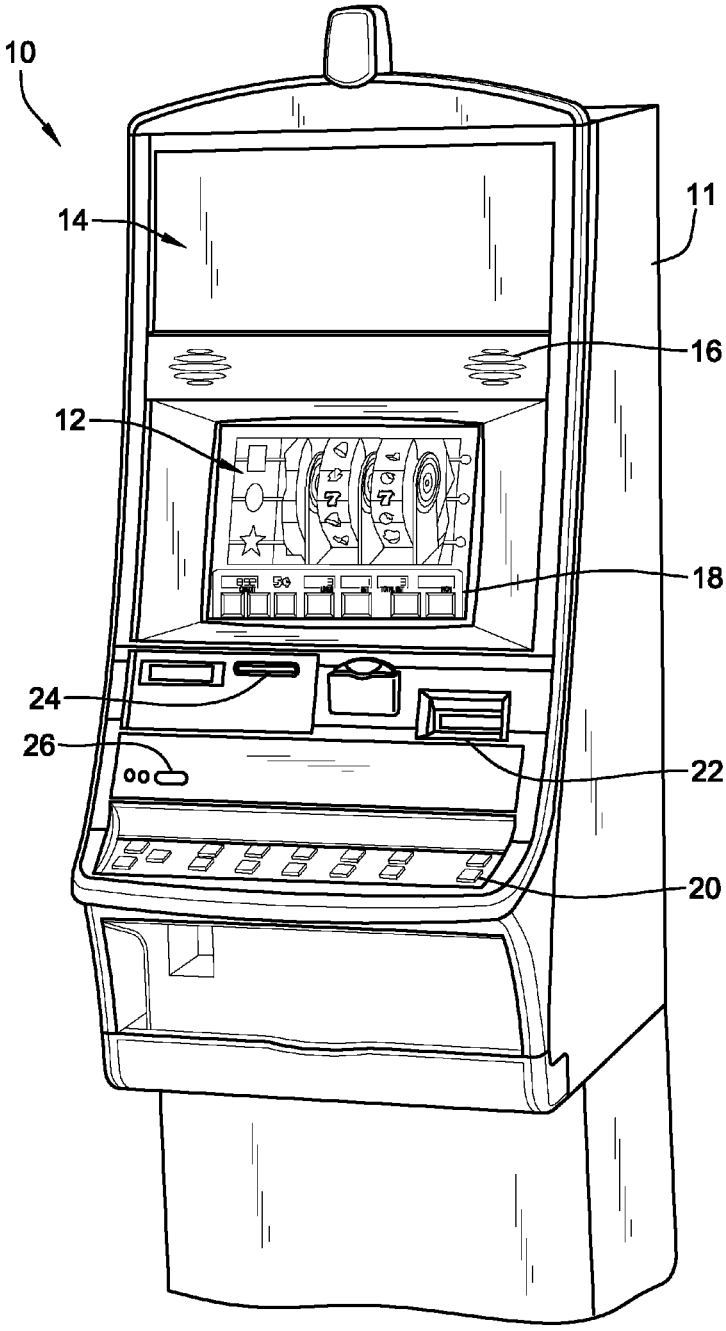
FIG. 1 (PRIOR ART)
FIG. 1 is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0069160 and US2010/0234099, which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
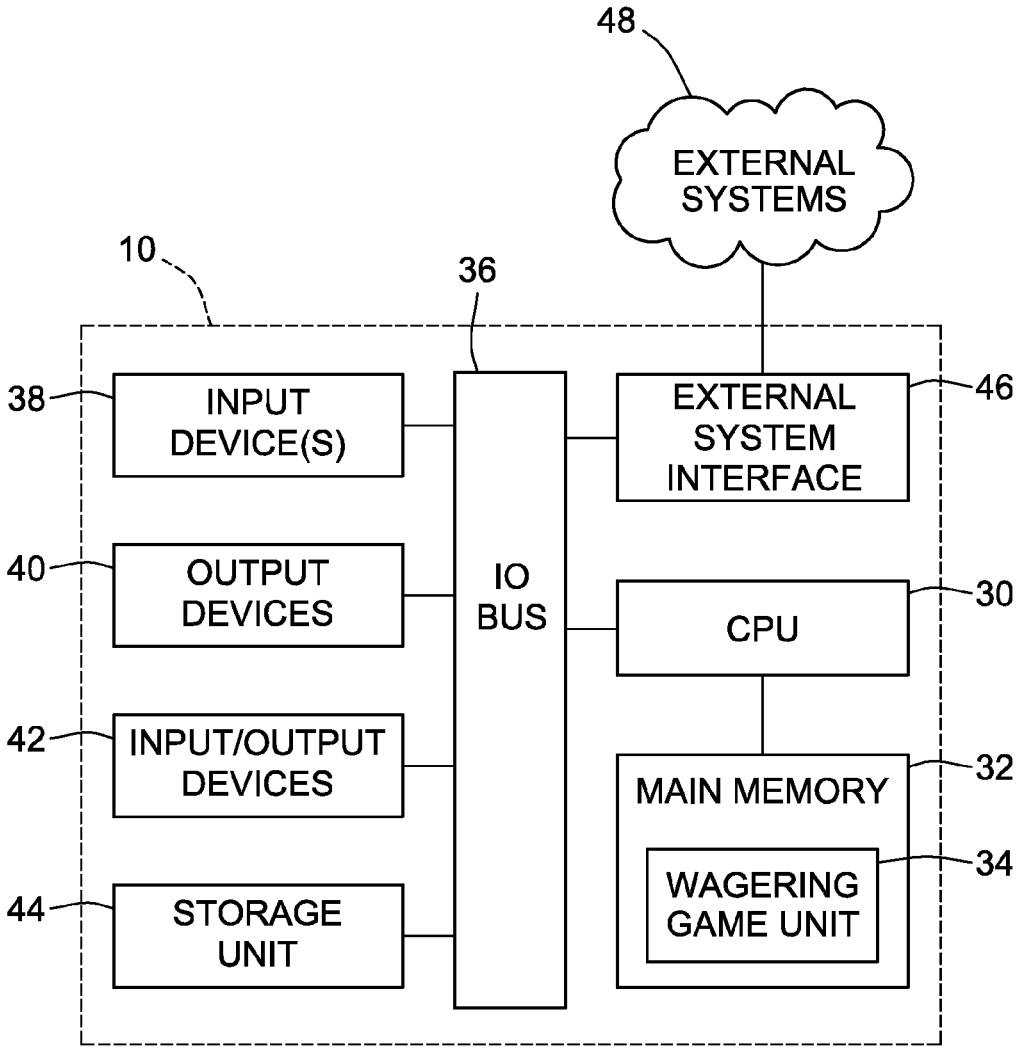
FIG. 2 (PRIOR ART)
FIG. 2 is a schematic view of a gaming system according to an embodiment of the present invention.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
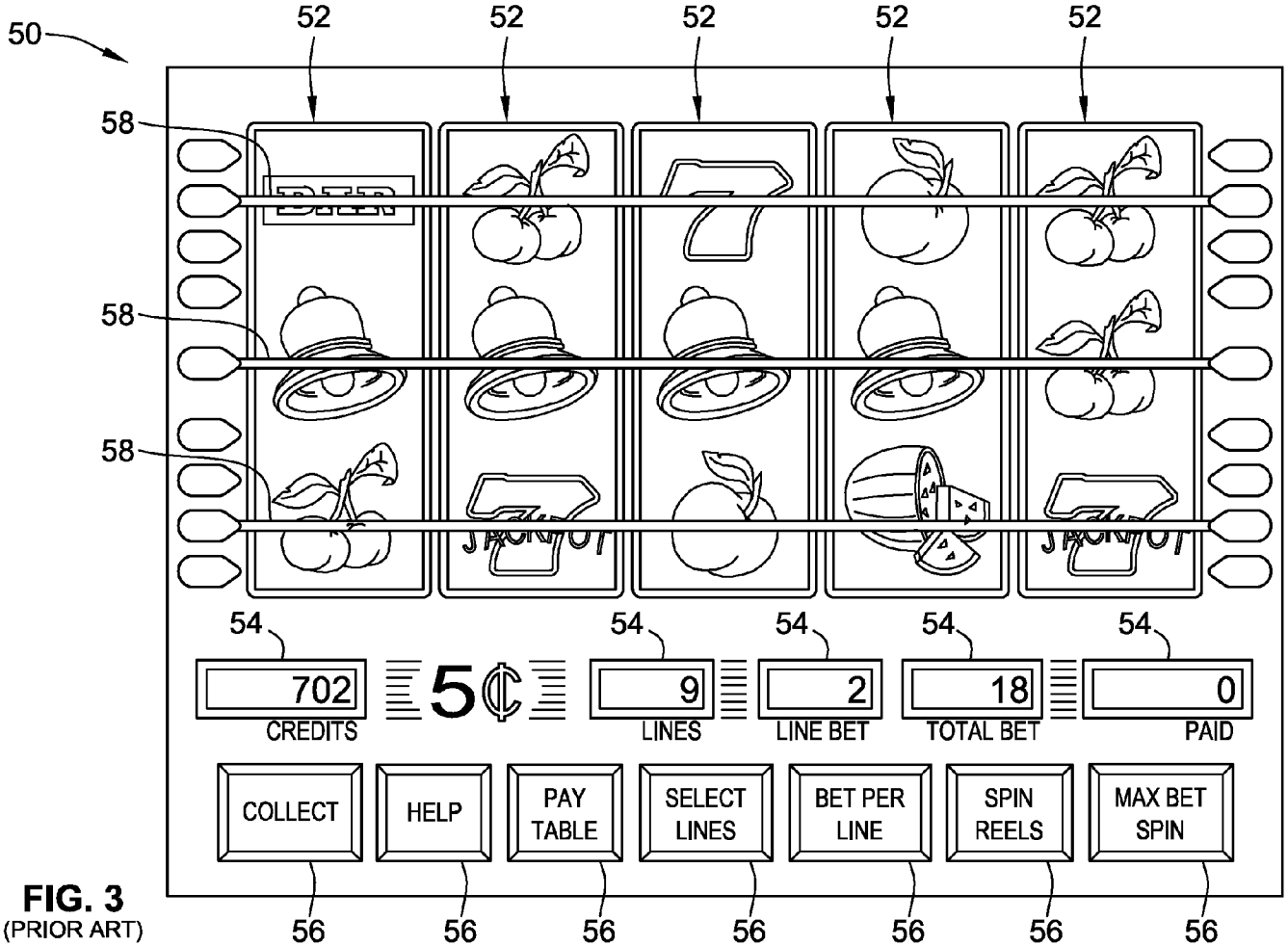
FIG. 3 (PRIOR ART)
FIG. 3 is an image of an exemplary basic-game screen of a wagering game displayed on a gaming terminal, according to an embodiment of the present invention.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4:
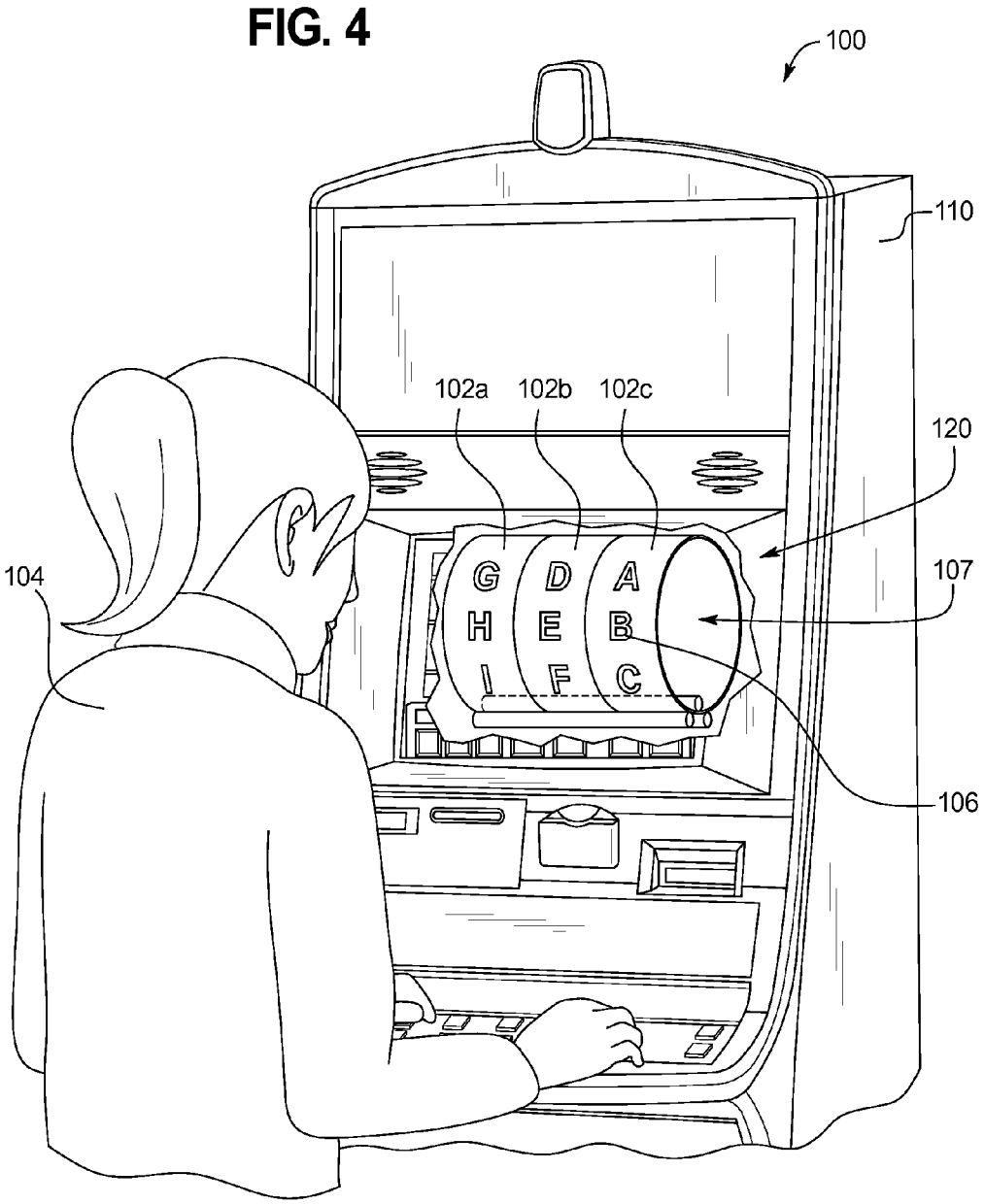
FIG. 4 is a perspective view illustration of a gaming terminal having hub-less reels.

Referring now to FIG. 4, a gaming terminal 100 includes a plurality of hub-less reels 102*a*-102*c*. The gaming terminal 100 includes one or more components similar to those discussed above in reference to gaming terminal 10 described above in reference to FIGS. 1-3. The hub-less reels 102*a*-102*c* are located within a cabinet 110 and are viewable in a primary display area 120 from a player position 104 in front of the cabinet 110. The hub-less reels are mounted within the cabinet 110 in a side-to-side arrangement to display symbols 106 indicative, at least in part, of a randomly selected outcome of a wagering game.

As discussed in more detail in the examples described below, the hub-less reels 102*a*-102*c* have an interior space 107 that is free of a hub or rotating shaft along a rotational axis. In prior reel systems, the hub is the central portion of the reel through which a rotating shaft passes for imparting rotational motion to the reel. In addition to the rotating shaft, the hub typically contains a motor and/or other drive-train components for rotating the reel. As such, the hub of a prior reel consists of and is cluttered with rotation-imparting components.

Moving the motor and/or other hub components outside the central portion of the reels 102*a*-102*c* opens a clear and open space inside the hub-less reels 102*a*-102*c*. For example, spokes to the center of the hub-less reels 102*a*-102*c* are no longer needed, allowing the open space to other objects through any number of the hub-less reels 102*a*-102*c*. With the central portion being an open space, aesthetic components, such as face plates, marquees, bezels, and even opaque reel strips, are no longer required. Accordingly, space surrounding the hub-less reels 102*a*-102*c* can be freed of extraneous components to provide more design freedom.

The open interior space 107 allows placement of other usable objects and devices inside the hub-less reels 102*a*-102*c*. For example, the hub-less reels 102*a*-102*c* can contain inside other video displays, lighting systems, coins, props, another set of reels, etc. According to another example, the symbols 106 can be in the form of small video displays on the hub-reels 102*a*-102*c*. Furthermore, the hub-less configuration provides greater torque capabilities, which, in turn, allows greater material design choices by allowing the use of heavier materials (e.g., metal).

Figure 5:
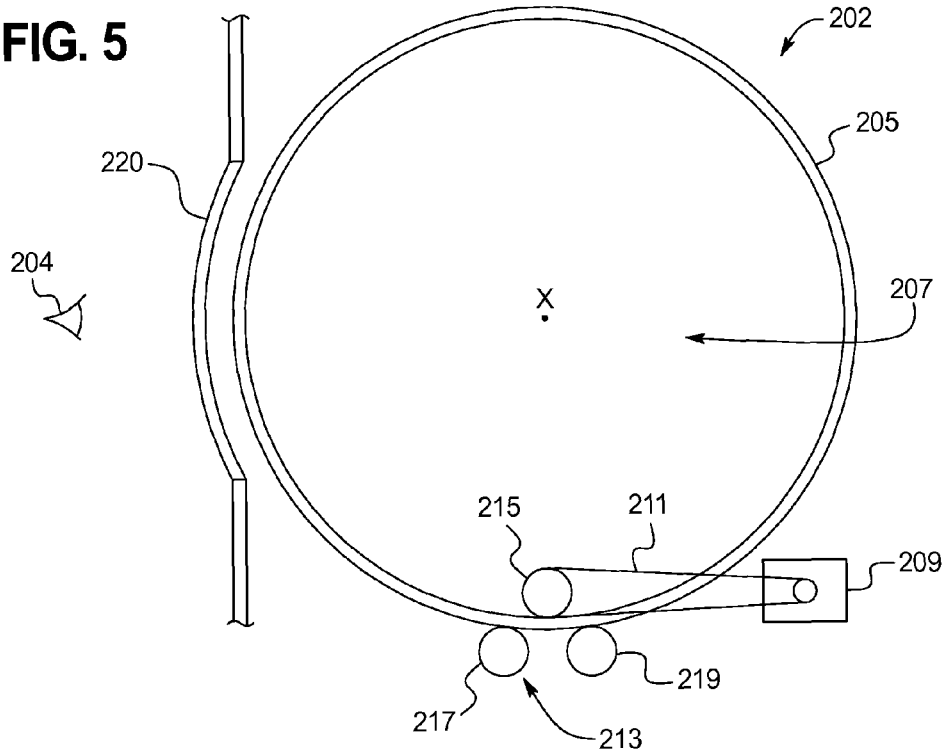
FIG. 5 is a side view illustration of a hub-less reel with a drive train having a three-wheel arrangement in which one wheel is inside the reel.

Referring to FIG. 5, a hub-less reel 202 is a cylindrical mechanical reel mounted in a cabinet display having a display area 220. The hub-less reel 202 is viewable from a player position 204 and is rotatable about an internal axis X. The hub-less reel 202 includes an outer rim 205 and an interior space 207, which is free of a hub along the internal axis X.

The hub-less reel 202 is driven by a motorized arrangement including a motor 209, a belt 211, and a drive train 213. The motor 209 is configured to rotate the hub-less reel about the internal axis X, and is positioned proximate the outer rim 205 and away from the internal axis X. Specifically, in this example, the motor 208 is positioned outside the interior space 207 and near an external surface of the outer rim 205, although the belt 211 provides freedom of design to allow the motor 209 to be separated from the reel 202.

The drive train 213 is coupled to and driven by the motor 209 via the belt 211. The drive train 213 includes a three-wheel arrangement having an interior wheel 215 and two exterior wheels 217, 219. The interior wheel 215 is the only wheel driven by the motor 208, with the exterior wheels 217, 219 providing stability and frictional resistance for rotating the hub-less reel 202. As such, the wheels 215, 217, 219 provide contact points for making contact with both an internal surface and an external surface of the outer rim 205. According to one example, the wheels 215, 217, 219 are rubber wheels. According to other examples, the drive train 213 can include, in addition to or instead of the rubber wheels, tracked teeth, geared teeth, and/or combination of wheels and reels using magnetic fields to ensure close proximity.

Figure 6:
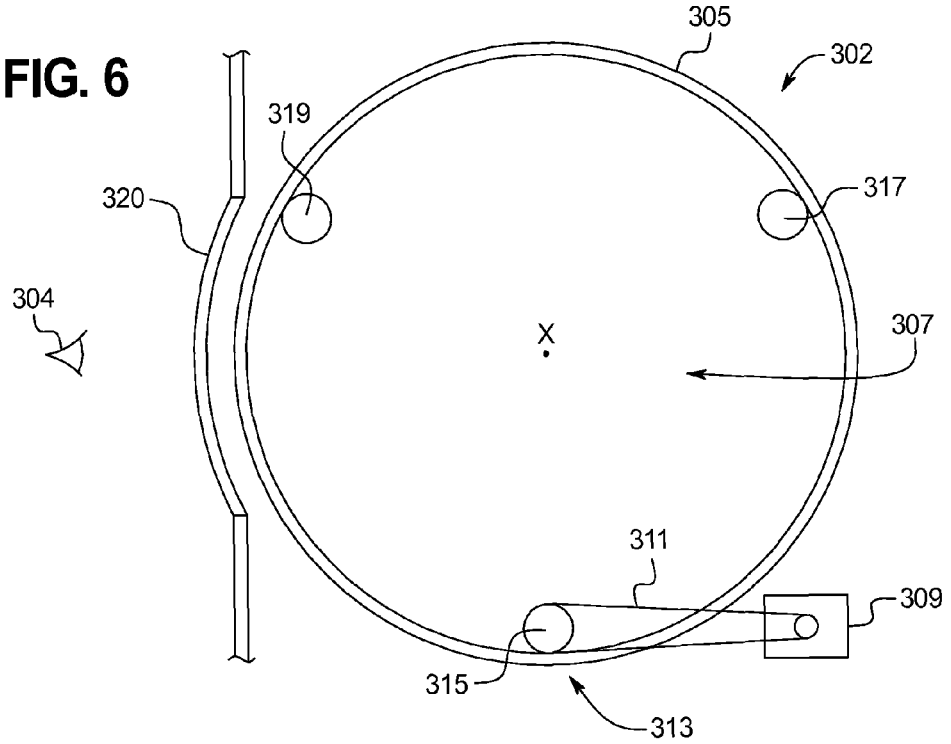
FIG. 6, is a side view illustration of a hub-less reel with a drive train having a three-wheel arrangement in which all the wheels are inside the reel.

Referring to FIG. 6, a hub-less reel 302 is viewable through a display area 320 from a player position 304 and is rotatable about an internal axis X. The hub-less reel 302 is generally similar to the hub-less reel 202 described above in reference to FIG. 5, being driven by a motorized arrangement including a motor 309, a belt 311, and a drive train 313. However, the drive train 313 includes a three-wheel arrangement in which each wheel 315, 317, 319 is an interior wheel. The wheels 315, 317, 319 are symmetrically arranged around an outer rim 305 and are positioned in contact with an internal surface of the outer rim 305. In accordance with this example, a majority of an interior space 307 is substantially free of any components of the hub-less reel 302, including the motor 309, the belt 311, and the drive train 313. According to one example, the interior space 307 is at least 75 percent free of any components of the hub-less reel 302.

Figure 7:
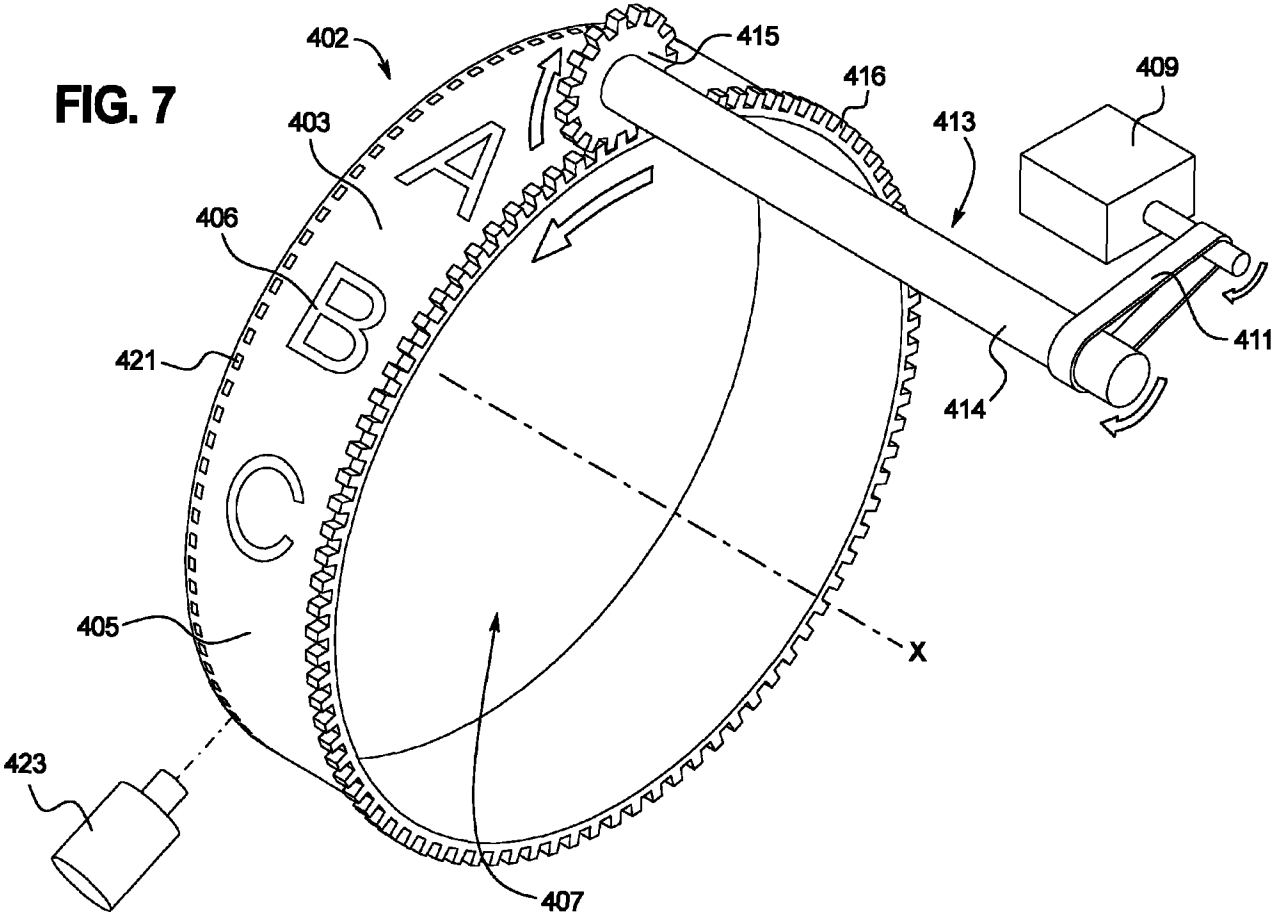
FIG. 7 is a perspective view illustration of a hub-less reel driven by a gear mechanism.

Referring to FIG. 7, a hub-less reel 402 is driven by a motorized arrangement including a motor 409, a belt 411, and a drive train 413. According to this example, the drive train includes an elongated shaft 414 having a gear wheel 415 that cooperates with a gear track 416 to rotate the hub-less reel 402 about an internal axis X. As the motor imparts clockwise direction to the gear wheel 415, the hub-less reel 402 rotates in a counter-clockwise direction.

The gear wheel 415 is positioned adjacent and external to an outer rim 405. Similarly, the gear track 416 is on an external surface of the outer rim 405. As such, an interior space 407 is completely free of any components of the hub-less reel 402. Alternatively, the gear wheel 415 can be positioned internal to the outer rim 405, with the gear track 416 being on an internal surface of the outer rim 405. According to this alternative interior arrangement, the interior space 407 would still have a majority of the space substantially free of components.

The outer rim 405 supports a strip 403 that bears a plurality of symbols 406. Alternatively, or in addition, to the strip 403, one or more conductive rails can be attached to the outer rim 405 with electrical circuitry for displaying video images of the symbols 406. As such, the outer rim 405 can have mechanical devices, electrical devices, and/or electro-mechanical devices for displaying one or more of a video image and a physical image indicative of the symbols 406. According to one example, the strip 403 includes at least one of a transparent and a translucent material.

The conductive rails allow electrical circuitry, and even electro-mechanical devices, to be built on the hub-less reel 402 itself. The conductive rails can include three primary rails (e.g., anode, cathode, and data rails) and/or additional rails for hard-wired controls (e.g., for parallel or multiple independent data lines). Optionally, the data may be embedded within the signals coupled to the cathode rails to reduce the number of rails to as few as two rails. The data may also be communicated wirelessly.

The hub-less reel 402 further includes a plurality of sensor markings 421 on the reel strip 403. According to this example, the sensor markings 421 are located along an edge of the outer rim 405 and are intended to provide positioning feedback detected by a sensor 423. As the hub-less reel 402 is being rotated by the motor 409, the sensor 423 detects the sensor markings 421 and provides feedback in reference to the position of the hub-less reel 402 and symbols 406. Particular symbol positions along the reel 402 may be determined by unique patterns of sensor markings 421 at the respective symbol positions or by counting the number of markings detected between a home position (which may be identified by a unique home position marking or pattern of markings 421) and the current position of the reel 402.

According to one example, the sensor markings 421 are detectable only via an infrared light sensor. According to another example, the sensor markings 421 are magnetic. Alternatively, the sensor markings 421 are located on an internal surface of the outer rim 405.

Optionally, the sensor markings 421 includes a single sensor for each stop position. Alternatively, instead of detecting the sensor markings 421, the sensor 423 is a camera that views reel symbols to verify a reel position by comparing a symbol image to a stored image. The camera 423 can also optionally very that the correct reel strip is installed on the reel 402 based on the comparison of the images.

Figure 8:
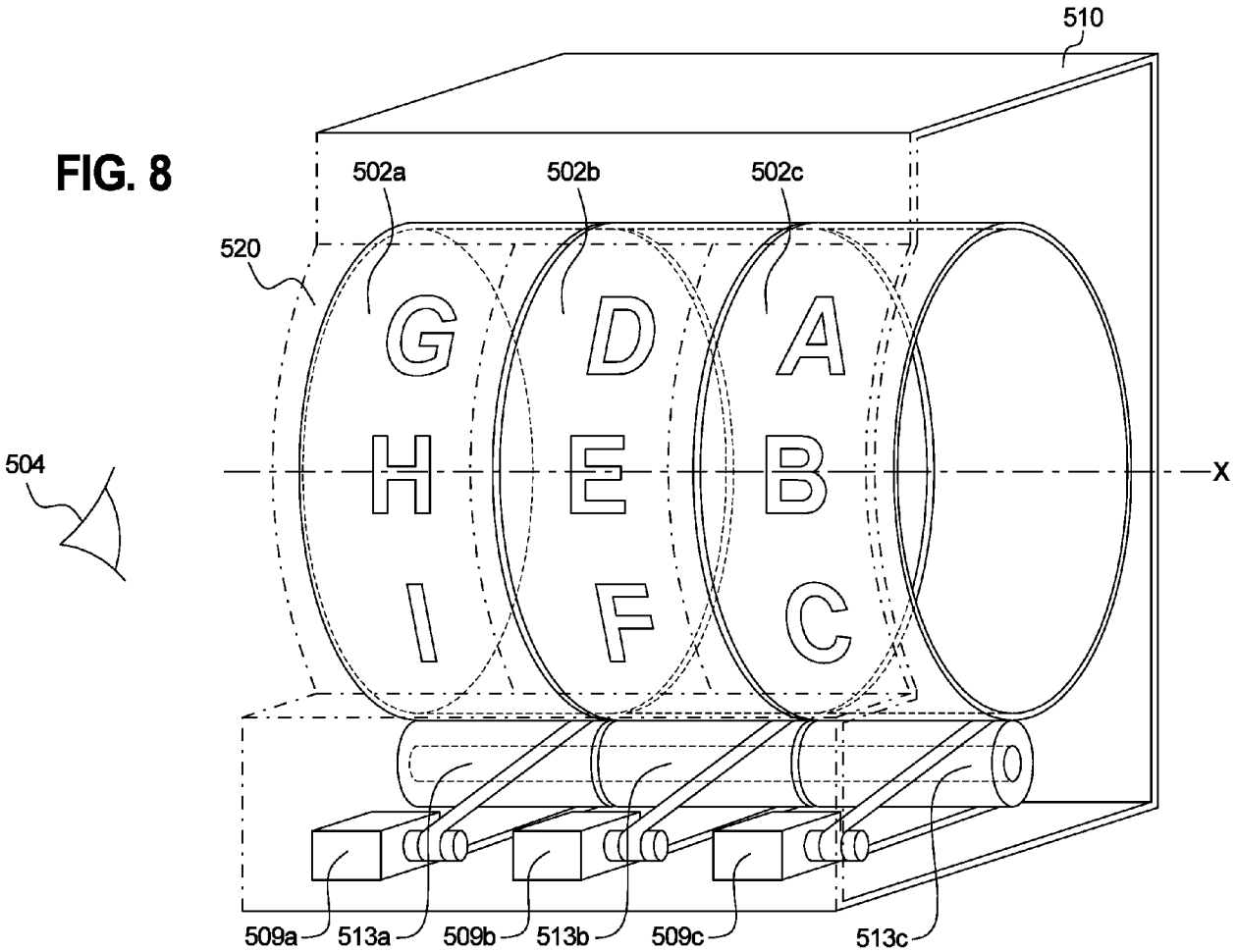
FIG. 8 is a perspective view illustration of a plurality of hub-less reels driven by a belt mechanism.

Referring to FIG. 8, a gaming terminal 500 has a cabinet 510 in which a plurality hub-less reels 502*a*-502*c* are mounted such that an internal axis X is horizontal relative to the cabinet 510. The hub-less reels 502*a*-502*c* are independently rotatable, via respective motors 509*a*-509*c*, and are arranged in a side-to-side configuration with at least a portion of each reel 502*a*-502*c* being viewable through a display area 520 from a player position 504. Each of the motors 509*a*-509*c* is coupled to a respective hub-less reel 502*a*-502*c* via a respective drive train 513*a*-513*c* having a rotatable shaft. According to this example, the rotatable shafts 513*a*-513*c* are aligned coaxially, but are independently rotatable.

Figure 9:
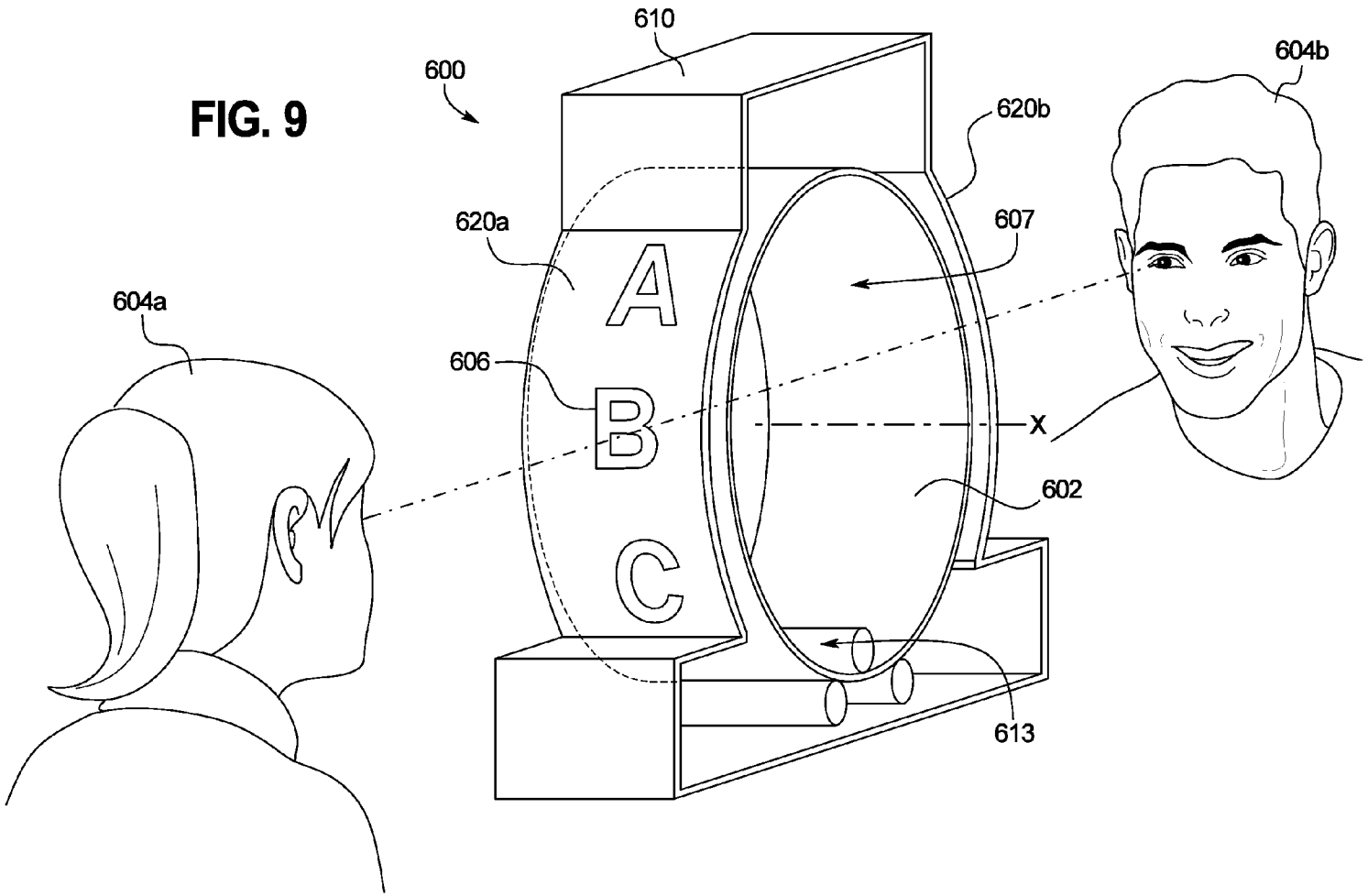
FIG. 9 is a perspective view illustration of a hub-less reel including a transparent material.

Referring to FIG. 9, a gaming terminal 600 includes a dual-display cabinet 610 having a first display area 620*a* and a second display area 620*b*. The display areas 620*a*, 620*b* are positioned on directly opposite sides of the cabinet 610 such that players from respective player positions 604*a*, 604*b* can view at least one common hub-less reel 602. According to one example, the display areas 620*a*, 620*b* include liquid crystal displays (LCDs). Although a single hub-less reel 602 is illustrated for ease of understanding, it is understood that the gaming terminal 600 can include additional hub-less reels in a side-to-side configuration.

The hub-less reel 602 is rotatable about an internal axis X and has an interior space 607 that is substantially free of any components. For example, the only component located in the interior space, is an interior wheel of a drive train 613. The hub-less reel 602 is made of a transparent material and includes a strip with symbols 606 for indicating a randomly selected outcome. Players viewing the hub-less reel 602 from both player positions 604*a*, 604*b* are able to view each other through the hub-less reel 602. The players are further able to view symbols 606 prior to the symbols being positioned within the display areas 620*a*, 620*b* thereby building player anticipation.

Accordingly, a feature of a wagering game can include an enhanced field of vision in which players can observe other player's facial expressions while playing the wagering game, players can observe symbols outside the typical display area (e.g., symbols that would otherwise be obscured from view by components and/or opaque materials). This feature is achievable, in part, by having a component-free space inside the hub-less reel 602. Optionally, at least a portion of the cabinet 610 itself is transparent and/or translucent to allow player viewing inside the hub-less reel 602.

Figure 10:
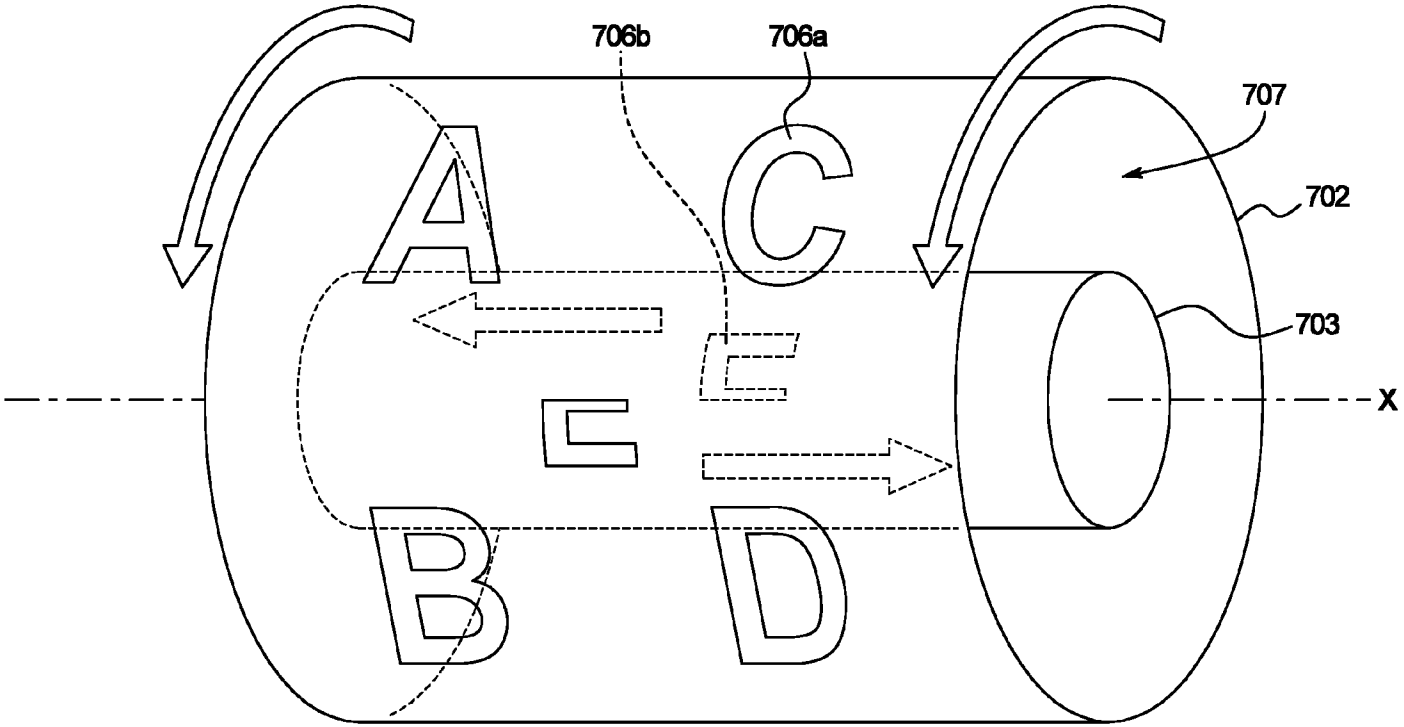
FIG. 10 is a perspective view illustration of a hub-less reel containing an independently-moving reel within an interior space.

Referring to FIG. 10, a reel configuration includes having an internal reel 703 mounted coaxial about an internal axis X within an outer hub-less reel 702. The internal reel 703 is located within an interior space 707 and is an additional reel that is independently movable from the outer hub-less reel 702. For example, the outer hub-less reel 702 is rotatable about the X axis while the internal reel 703 is independently movable along the X axis (e.g., in a horizontal reciprocating motion). Alternatively, the internal reel 703 is independently rotatable and/or translational relative to the hub-less reel 702. The internal reel 703 can itself be a hub-less reel or can have a hub.

Optionally, the outer hub-less reel 702 is transparent such that symbols 706*b* on the internal reel 703 are viewable through the hub-less reel 702. The symbols 706*b* on the internal reel 703 can indicate a randomly selected outcome by themselves or with other symbols 706*a* on the hub-less reel 702. According to another example, additional reels can be mounted in a side-to-side configuration to have a plurality of outer hub-less reels and a plurality of inner reels.

According to yet another example, the reels 702, 703 are not coaxial. In other words, the internal reel 703 is has its own internal axis that is distinct from the internal axis of the outer hub-less reel 702.

Figure 11:
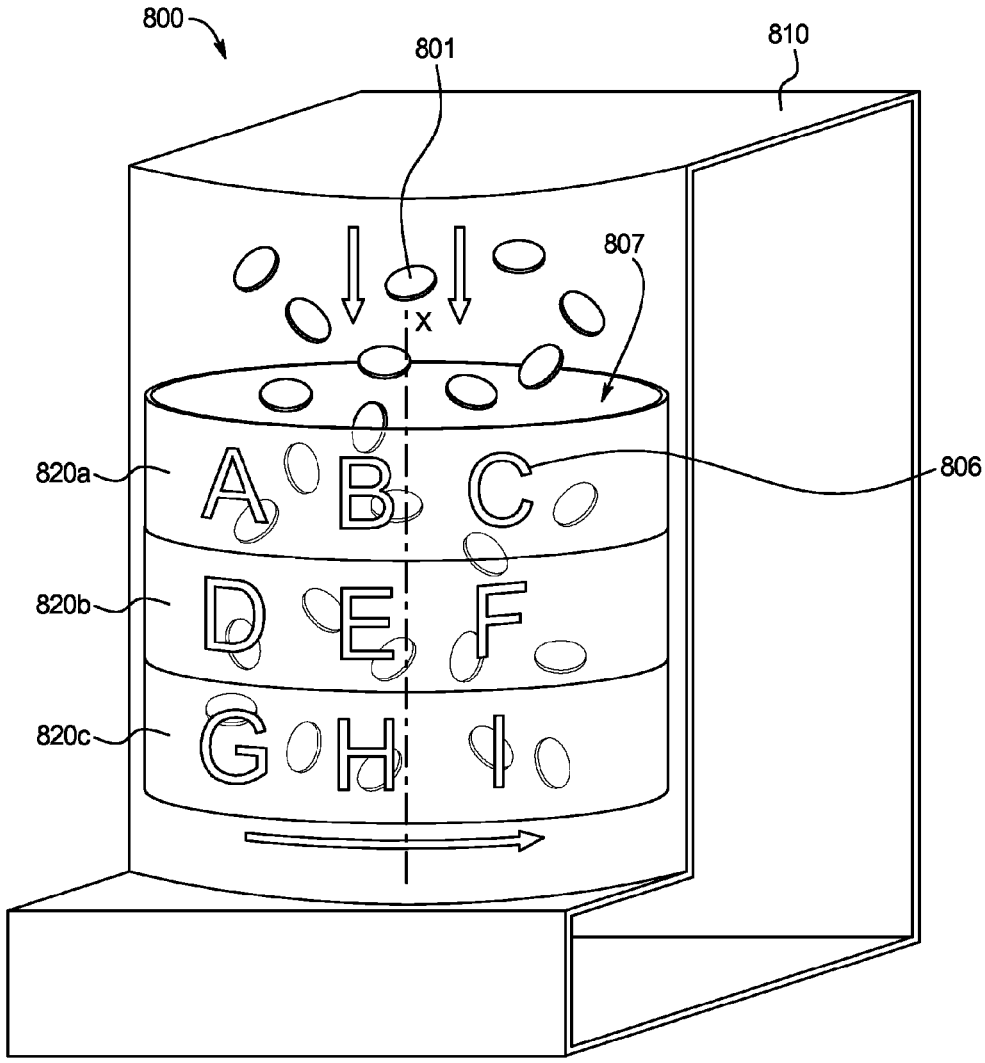
FIG. 11 is a perspective view illustration of coins being dropped through an interior space of a hub-less reel.

Referring to FIG. 11, a gaming terminal 800 has a cabinet 810 and includes a plurality of hub-less reels 802*a*-802*c* rotatable about an internal axis X. The hub-less reels 802*a*-802*c* have an interior space 807 and are oriented such that the internal axis X is vertical relative to the cabinet 810. A plurality of coins 801 are dropped through the interior space 807 to present game-related effects. Thus, this configuration relies on gravity to temporarily move objects through the interior space 807. The coins 801 can be collected in a bottom receptacle and re-circulated through the interior space 807 in a continuous or semi-continuous cycle.

Optionally, the coins 801 are dropped only during certain game events, e.g., when a jackpot is awarded. The hub-less reels 802*a*-802*c* are rotatable independently of the motion of the coins 801. However, the rotational movement of the hub-less reels 802*a*-802*c* can be synchronized with the falling motion of the coins 801 for further game-related effects.

In an alternative embodiment, the hub-less reels 802*a*-802*c* are oriented such that the internal axis is horizontal relative to the cabinet 810. Instead of using gravity, the coins 801 (or other objects) are forced through the interior space 807 via other mechanical or conveyance means that throw or pull the coins 801. Alternatively, the coins 801 are video images (instead of physical objects) that are displayed inside the interior space 807 using video display and/or video projection devices.

Figure 12:
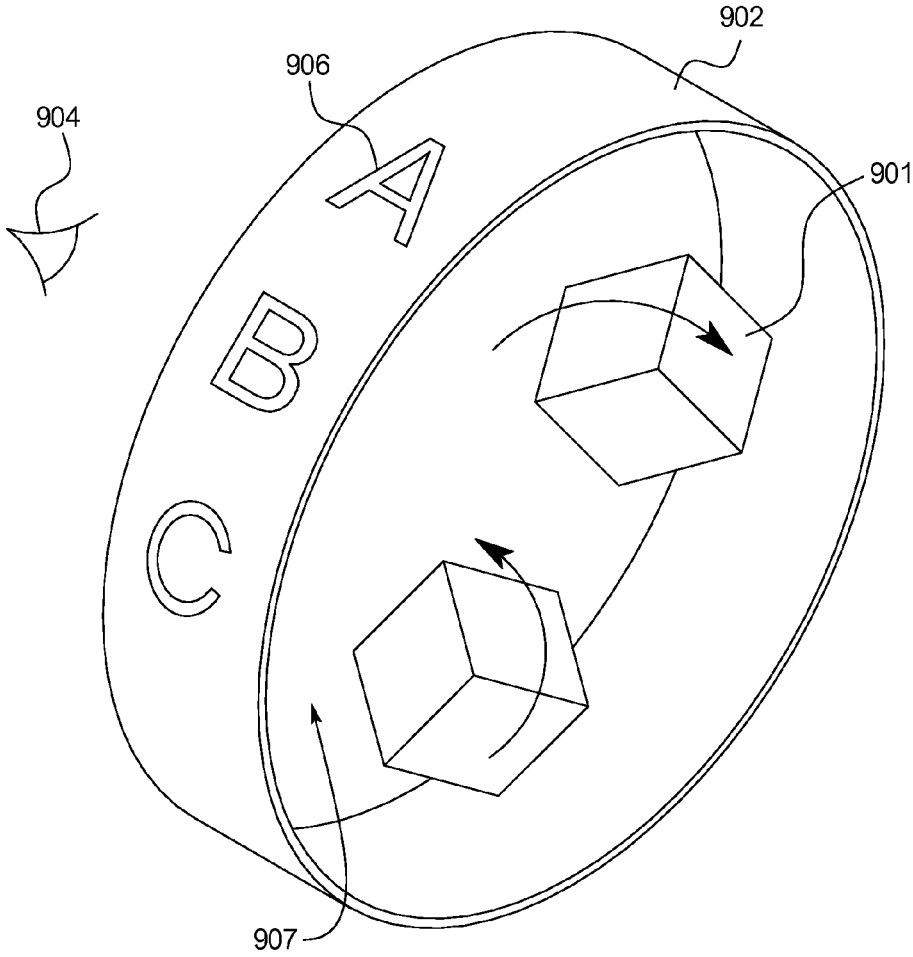
FIG. 12 is a perspective view illustration of a hub-less reel with a pair of mechanical dice moving within an interior space of the reel.

Referring to FIG. 12, a hub-less reel 902 has symbols 906 that are viewable from a player position 904 and includes in an interior space 907 a pair of physical objects 901. According to one example, the objects 901 are a pair of dice that are movable to simulate an action in which a player throws the dice. The objects 901 are independently movable relative to a rotational motion of the hub-less reel 902, but can be moved in coordination with the movement of the hub-less reel 902.

Figure 13:
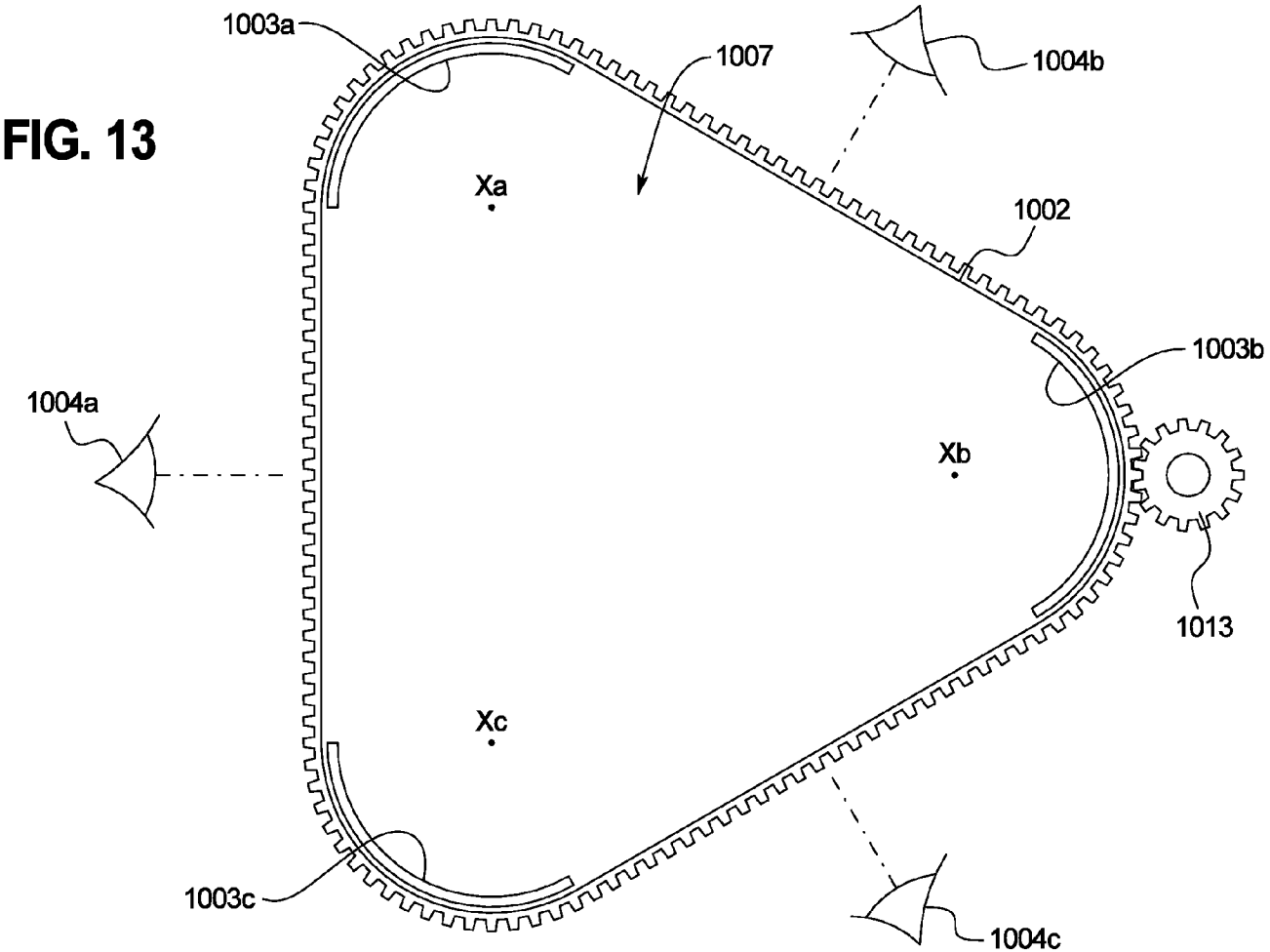
FIG. 13 is a side view illustration of a hub-less reel having a belt configuration.

Referring to FIG. 13, a hub-less reel 1002 is shared by a plurality of players playing from respective player positions 1004*a*-1004*c*. The hub-less reel 1002 is driven via a drive train 1013, which in this example includes a gear configuration for driving the hub-less reel 1002. The hub-less reel 1002 is a continuous loop having three supports 1003*a*-1003*c* located within an interior space 1007. The hub-less reel 1002 rotates around each of three respective axes Xa-Xc, which are located near a corresponding support 1003*a*-1003*c*. According to one example, the hub-less reel 1002 is mounted within one common cabinet and displays symbols to one or more players positioned at the player positions 1004*a*-1004*c*.

Figure 14:
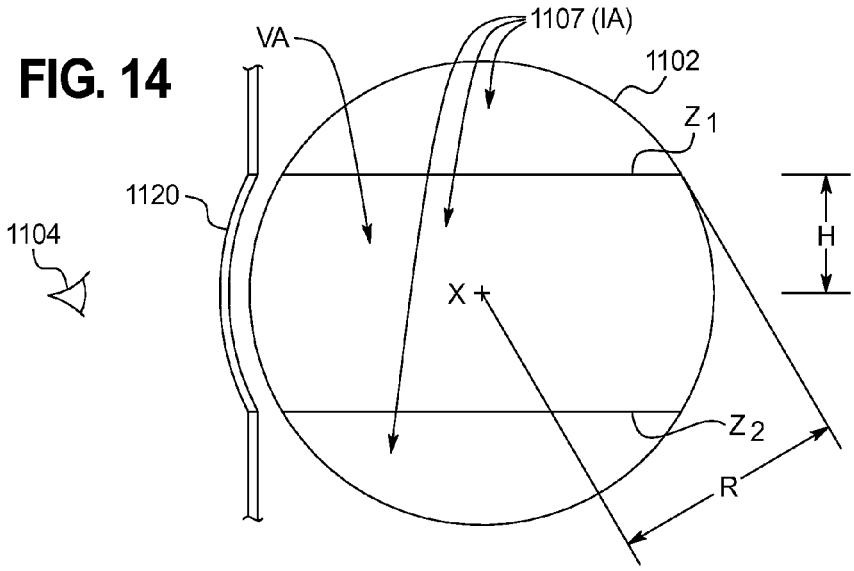
FIG. 14 is a side view illustration of a hub-less reel having a maximum viewable interior space.

Referring to FIG. 14, a cylindrical hub-less reel 1102 includes a cylindrical interior space 1107 that, when viewed along a plane perpendicular to an internal axis X, is a circular interior IA. A viewable area VA inside the hub-less reel 1102 can be determined based on a height H from the internal axis X and a radius R of the hub-less reel 1102. The viewable area VA is the portion of the interior area IA that a player standing in a player position 1104 can generally view through a display area 1120. Thus, the viewable area VA is the area between lines Z1 and Z2, and can be determined as a function of height H and radius R using the following equation:

$$VA = 2RH\sqrt{1-\left(\frac{H}{R}\right)^2} + 2R^2\sin^{-1}\left(\frac{H}{R}\right) \quad \text{(Equation 1)}$$

Figure 15:
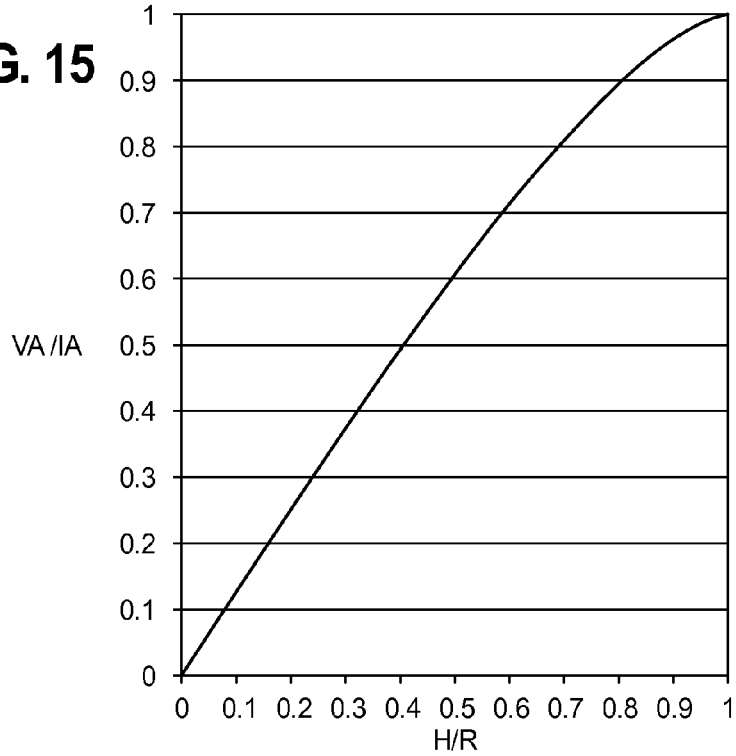
FIG. 15 is a chart illustrating a geometric plot indicative of the maximum viewable interior space of FIG. 14.

Referring to FIG. 15, a plot of the ratio between the viewable area VA and the interior area IA and the ratio between the height H and the radius R can be determined based on the following equation:

$$\frac{VA}{IA} = \frac{2}{\pi}\frac{H}{R}\sqrt{1-\left(\frac{H}{R}\right)^2} + \frac{2}{\pi}\sin^{-1}\left(\frac{H}{R}\right) \quad \text{(Equation 2)}$$

As illustrated, the entire interior area IA becomes viewable when the height H is equal to the radius R. According to some other examples:

| H/R | VA/IA |
|---|---|
| 0.5 | 0.609 |
| 0.6 | 0.715 |
| 0.7 | 0.812 |
| 0.8 | 0.896 |
| 0.9 | 0.963 |

Each of these embodiments and obvious variations thereof is contemplated as falling within the spirit and scope of the claimed invention, which is set forth in the following claims.

What is claimed is:

1. A gaming machine comprising:

a cabinet; and at least one cylindrical mechanical reel mounted in the cabinet to display symbols indicative, at least in part, of a randomly selected outcome of a wagering game, the mechanical reel being rotatable about a fixed internal axis, the mechanical reel defining an interior space that is free of a hub along the internal axis.

2. The gaming machine of claim 1, wherein the mechanical reel includes an outer rim supporting a strip that bears the symbols.

3. The gaming machine of claim 2, further comprising a motor mounted proximate the rim and away from the internal axis, the motor configured to rotate the mechanical reel about the internal axis.

4. The gaming machine of claim 3, wherein the motor is mounted adjacent to an external surface of the rim.

5. The gaming machine of claim 2, further comprising a drive train having contact points for making contact with both an internal surface and an external surface of the rim, the drive train being coupled to and driven by the motor.

6. The gaming machine of claim 5, wherein the drive train is selected from a group consisting of rubber wheels, tracked teeth, geared teeth, magnetic fields, and a belt.

7. The gaming machine of claim 5, wherein the drive train includes an arrangement of at least three wheels, at least one of the wheels being a driven wheel rotated by the motor.

8. The gaming machine of claim 7, wherein the wheels are symmetrically arranged around the rim.

9. The gaming machine of claim 2, further comprising one or more conductive rails attached to the rim and having electrical circuitry for displaying video images of the symbols on the strip.

10. The gaming machine of claim 2, further comprising electro-mechanical devices attached to the rim for displaying images on the mechanical reel, the images including one or more of a video image and a physical image indicative of the symbols.

11. The gaming machine of claim 2, wherein the strip includes at least one of a transparent and a translucent material.

12. The gaming machine of claim 1, wherein a majority of the interior space is substantially free of any components of the mechanical reel.

13. The gaming machine of claim 12, wherein at least 75 percent of the interior space is free of any components of the mechanical reel.

14. The gaming machine of claim 1, wherein the mechanical reel is mounted such that the internal axis is horizontal relative to the cabinet.

15. The gaming machine of claim 1, further comprising an additional reel mounted coaxial with the mechanical reel within the interior space, the additional reel being independently rotatable from the mechanical reel.

16. The gaming machine of claim 1, further comprising temporarily moving objects through the interior space for presenting game-related effects.

17. A gaming machine comprising:

at least one cylindrical mechanical reel mounted to display symbols indicative, at least in part, of a randomly selected outcome of a wagering game, the mechanical reel being rotatable about an internal axis and including an outer rim; and a motor and drive train configured to rotate the mechanical reel about the internal axis, the motor and drive train being mounted adjacent to the outer rim and away from the internal axis.

18. The gaming machine of claim 17, wherein the mechanical reel contains a central space around the internal axis, the motor and drive train being mounted outside the central space.

19. The gaming machine of claim 18, wherein a majority of the central space is substantially free of any components of the mechanical reel.

20. The gaming machine of claim 19, wherein at least 75 percent of the central space is free of any components of the mechanical reel.

21. The gaming machine of claim 18, further comprising temporarily moving objects through the central space for presenting game-related effects.

22. The gaming machine of claim 17, wherein the outer rim supports a strip that includes at least one of a transparent and a translucent material.

23. The gaming machine of claim 17, further comprising electro-mechanical devices attached to the outer rim for displaying images on the mechanical reel, the images including one or more of a video image and a physical image indicative of the symbols.

24. The gaming machine of claim 17, further comprising an additional reel mounted coaxial with the mechanical reel within the central space, the additional reel being independently rotatable from the mechanical reel.

25. A gaming machine comprising:

at least one cylindrical mechanical reel mounted to display symbols indicative, at least in part, of a randomly selected outcome of a wagering game, the mechanical reel being rotatable about an internal axis and including an outer rim, the mechanical reel containing a central space around the internal axis; and a motor and drive train configured to rotate the mechanical reel about the internal axis, the motor and drive train being mounted adjacent to the outer rim and outside the central space.

26. The gaming machine of claim 25, wherein a majority of the central space is substantially free of any components of the mechanical reel.

27. The gaming machine of claim 26, wherein at least 75 percent of the central space is free of any components of the mechanical reel.

28. The gaming machine of claim 25, further comprising temporarily moving objects through the central space for presenting game-related effects.

29. The gaming machine of claim 25, wherein the outer rim supports a strip that includes at least one of a transparent and a translucent material.

30. The gaming machine of claim 25, further comprising electro-mechanical devices attached to the outer rim for displaying images on the mechanical reel, the images including one or more of a video image and a physical image indicative of the symbols.

* * * * *